United States Patent [19]

Andersen

[11] Patent Number: 4,503,769

[45] Date of Patent: Mar. 12, 1985

[54] METAL COATED THIN WALL PLASTIC PRINTING CYLINDER FOR ROTOGRAVURE PRINTING

[75] Inventor: Dennis Andersen, Medford, N.J.

[73] Assignee: Armotek Industries, Inc., Palmyra, N.J.

[21] Appl. No.: 390,379

[22] Filed: Jun. 21, 1982

[51] Int. Cl.[3] ..... B41F 9/00

[52] U.S. Cl. ..... 101/153; 29/117; 101/170; 101/401.1; 204/20; 204/25; 428/675

[58] Field of Search ..... 29/117; 101/375, 401.1, 101/153, 170; 204/20, 25; 428/36, 675

[56] References Cited

U.S. PATENT DOCUMENTS

| | | | |
|---|---|---|---|
| 662,852 | 11/1900 | Hett | 204/25 |
| 748,004 | 12/1903 | Pancoast | 204/25 |
| 972,906 | 10/1910 | Pancoast | 101/375 |
| 1,319,107 | 10/1919 | Novotny | 101/375 |
| 1,674,635 | 6/1928 | Burden | 101/375 |
| 1,809,466 | 6/1931 | Albrecht | 101/153 |
| 1,958,299 | 5/1934 | Ericksson | 101/375 |
| 2,294,879 | 9/1942 | Affelder | 101/382 R |
| 2,429,752 | 10/1947 | Greulach | 29/117 |
| 2,776,256 | 1/1957 | Eulner | 204/25 |
| 3,282,659 | 11/1966 | Harrover | 428/675 |
| 3,305,460 | 2/1967 | Lacy | 204/20 |
| 3,478,684 | 11/1969 | Schafler | 428/675 |
| 3,527,579 | 9/1970 | Cines | 428/675 |
| 3,547,784 | 12/1970 | Bernhardt | 204/20 |
| 3,738,265 | 6/1973 | Saueressig | 101/375 |
| 3,857,681 | 12/1974 | Yates | 428/675 |
| 3,885,494 | 5/1975 | Saueressig | 101/375 |
| 4,301,727 | 11/1981 | Bardin | 101/153 |

FOREIGN PATENT DOCUMENTS

| | | | |
|---|---|---|---|
| 748422 | 8/1951 | Fed. Rep. of Germany | 101/375 |
| 1005978 | 4/1957 | Fed. Rep. of Germany | 101/375 |
| 2310987 | 9/1973 | Fed. Rep. of Germany | 101/375 |
| 7807649 | 2/1979 | Netherlands | 101/375 |
| 514632 | 11/1939 | United Kingdom | 101/375 |
| 2031801 | 4/1980 | United Kingdom | 101/375 |

*Primary Examiner*—Clyde I. Coughenour
*Attorney, Agent, or Firm*—Burns, Doane, Swecker & Mathis

[57] ABSTRACT

A lightweight, thin walled, plural metal coated plastic sleeve for use in rotogravure or flexographic printing as well as a rotogravure printing cylinder are disclosed. The sleeve is supported internally and laterally by, for example, an expanding mandrel containing journal bearings and the resulting combination may be used as a rotogravure printing cylinder in a rotogravure printing machine. The sleeve and cylinder are lightweight and easy to handle and store and are adapted for quick changes in the printing machine without removal of the journals and the internal support. The particular method of making the sleeve enhances the adhesion of the copper to the plastic base.

17 Claims, 6 Drawing Figures

FIG. 4
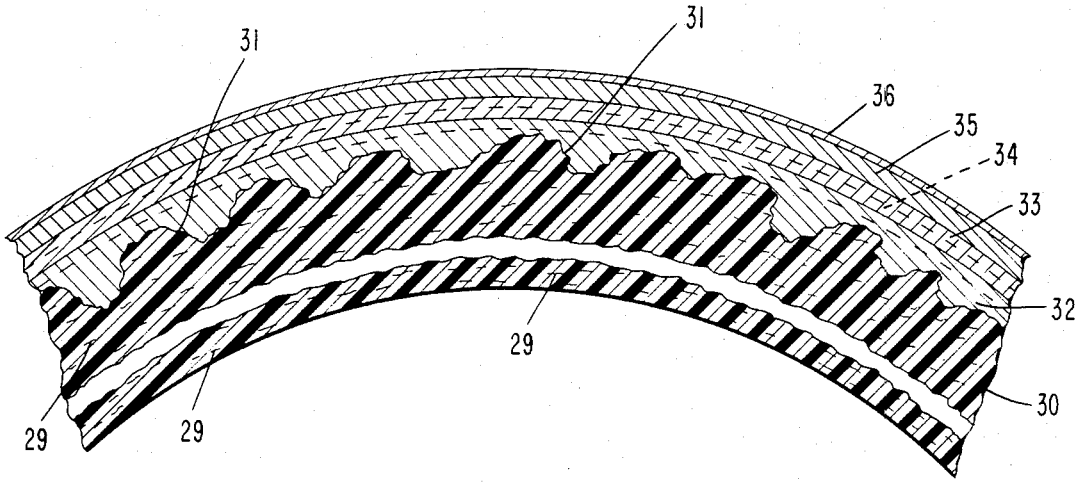
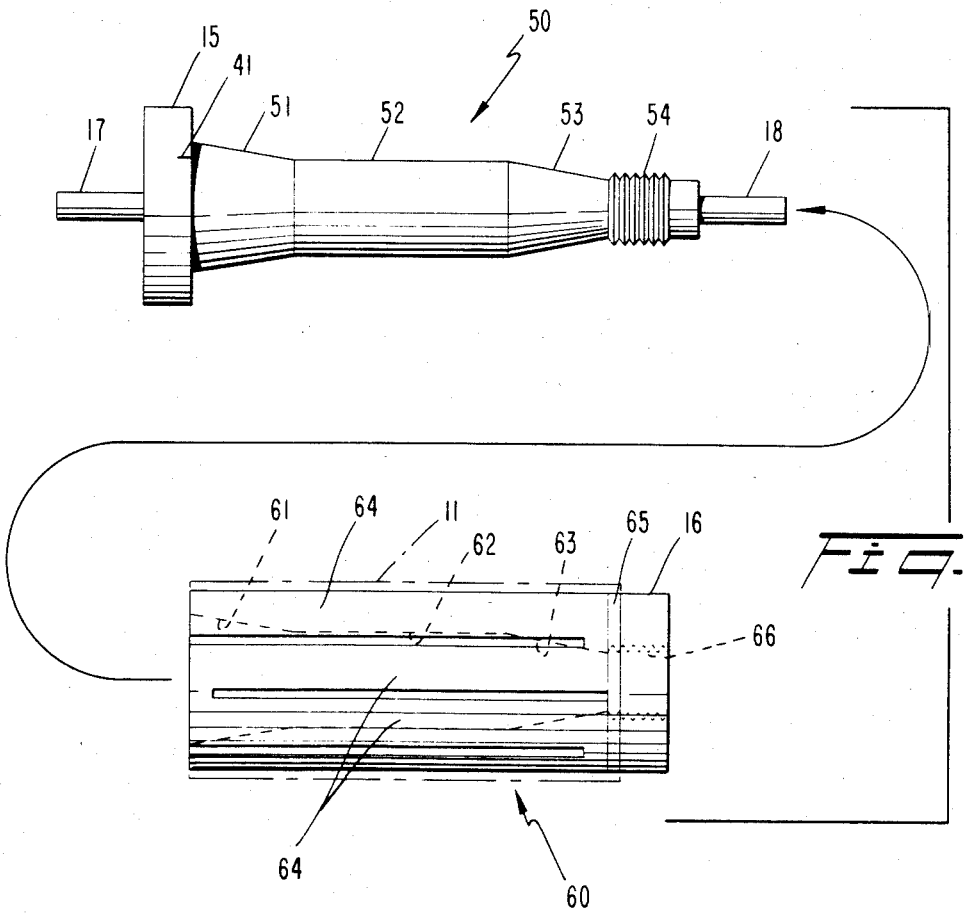
FIG. 5

METAL COATED THIN WALL PLASTIC PRINTING CYLINDER FOR ROTOGRAVURE PRINTING

BACKGROUND AND OBJECTS OF THE INVENTION

The present invention relates to the formation of a metal coated thin wall plastic printing cylinder for flexographic and rotogravure printing.

There have been many attempts to produce plastic based, metal coated printing plates or rolls since the advantages of such products are readily apparent. That is, the resulting printing plates or rolls would be relatively lightweight which would facilitate handling, transfer and storage. There are a number of patents dealing with metal coated plastic printing plates (see for example U.S. Pat. Nos. 3,558,290; 3,483,074; 3,351,009; and others).

Generally, copper is the preferred metal for the external surface of the printing plate or roll to receive the printing image. The coating of copper onto a base metal (e.g., iron or steel) is relatively straightforward but the coating of copper onto a non-conductive substrate can be difficult. U.S. Pat. No. 3,483,074 discloses a printing plate which is made of a filled polyethylene coated with silver and then copper. However, silver is quite expensive so this method is not commercially feasible. In addition, it has been found that the mode of application of copper is often important in determining the ultimate utility of the printing base and particularly for use in rotogravure printing cylinders.

Rotogravure printing cylinders contain an etched metal (generally copper) surface which is the desired printed image. One of the difficulties with metal coated plastic based printing cylinders has been the ability to plate copper onto the plastic cylinders. While such a coating has occasionally been done, it has been found that in use, the copper layer tends to separate and/or blister and ultimately separate from the plastic cylinder. Rotogravure printing is known to be a high quality process used for the production of wallpaper, packaging materials, floor covering, tag and label and other, more or less continuously printed patterns which can be run in relatively long runs. The rotogravure printing cylinder prints on a complete 360 degree circumference. Maintaining a stable metal coating on a roll or cylinder under rotogravure printing conditions is more difficult than maintaining it stable on a plate which is used in a flat condition during printing. In addition, rotogravure printing requires the use of the roll at substantial pressures and high surface speed. These conditions of use tend to aggravate the separation problems found with metal coated plastic printing rolls. The art, thus, has not sufficiently developed to produce a reliable thin wall plastic based, metal coated printing plate suitable for use in rotogravure and/or flexographic printing operations.

As noted, another advantage of a lightweight plastic based rotogravure printing roll is its ability to be handled and stored as compared to conventional copper plated, steel printing cylinders. It would be particularly useful to have a plastic-based printing cylinder that could be replaced by a similar plastic-based printing cylinder having the same or a different printing image without having to take apart the printing press and particularly without having to take apart at least one of the journal portions of the printing press since, in that fashion, alignment of the new metal coated plastic-based cylinder could be made substantially quicker. In the installation of a conventional copper-coated steel rotogravure cylinder today, alignment can take several hours.

Recent patents on metal coated, plastic-based intaglio printing cylinders include U.S. Pat. Nos. 4,197,798 and 4,301,727. In each of these patents the plastic cylinder base is rather massive and generally resembles a conventional printing cylinder in which the steel or iron has been replaced by a fiber-filled plastic and onto which an etchable copper surface is directly electroplated. However, this construction requires a rather precise plastic cylinder as well as a relatively complicated electroplating procedure to plate the copper onto the massive plastic base. In addition, these cylinders do not have several of the desired features discussed above and suffer from the problems relating to copper/plastic adherence noted above.

It is therefore an object of the present invention to provide means for alleviating the problems of the prior art.

It is a further object of the present invention to provide metal coated, thin wall plastic cylinders for use in flexographic and rotographic printing and methods of making same.

It is another object of the present invention to provide thin wall metal coated plastic printing cylinders for flexographic and rotographic printing which can be quickly and easily replaced and aligned in the printing machinery.

SUMMARY OF THE INVENTION

In these and other aspects of the invention, there is provided a rotogravure printing cylinder combination comprising at least one etchable thin walled, plural metal coated hollow plastic cylinder sleeve, means within said hollow plastic cylinder sleeve sufficient to provide support for said cylinder during printing; and journal means disposed at the ends of the cylinder sleeve to provide support for said cylinder in a rotogravure printing machine. There is also provided, in a rotogravure printing press including at least one rotogravure roll or cylinder and at least one impression roll, the improvement which comprises using the above-described rotogravure printing cylinder as the rotogravure cylinder.

There is also provided a rotogravure printing cylinder sleeve comprising a thin walled hollow plastic cylinder having a first zinc layer mechanically interlocked thereon, a first copper layer and a second copper layer of the same or greater hardness than the said first layer, said second copper layer being capable of being etched.

Also provided is a process for forming a sleeve adapted for use in rotogravure printing which comprises providing a thin wall plastic cylinder, distorting the surface thereof to provide means to interlock a subsequent zinc coating onto the plastic, applying a zinc coating which is mechanically interlocked with the plastic substrate, plasma spraying a thin layer of copper onto the zinc layer and electroplating a further layer of copper onto the sprayed copper layer.

BRIEF DESCRIPTION OF THE DRAWINGS

FIG. 4 is a cross section through FIG. 1 at line A—A;

FIG. 5 is a view in exploded view of a mandrel upon which the cylinder of FIG. 3 may be used.

DETAILED DESCRIPTION

Figure 1:
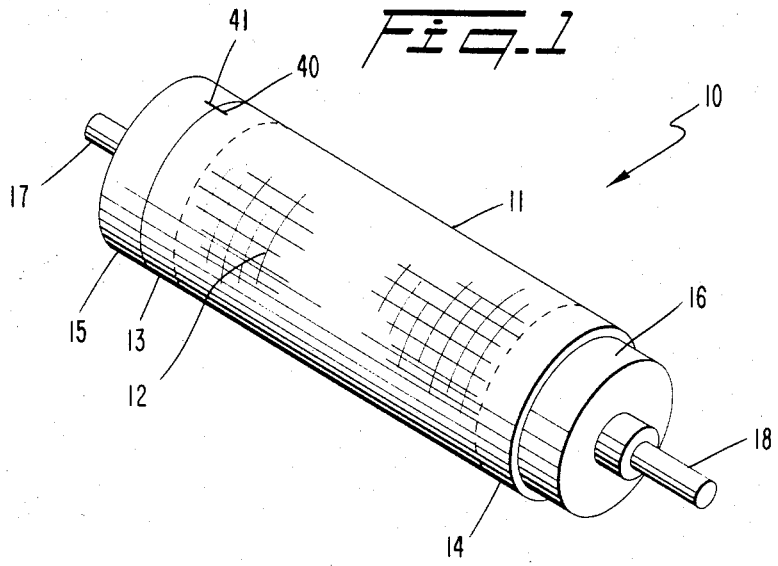
FIG. 1 is a perspective showing a finished rotogravure roll of the present invention.

The rotogravure printing cylinder of the present invention is indicated generally as 10 in FIG. 1. The cylinder includes a thin-walled metal coated plastic cylindrical sleeve 11 (the details of which are set forth hereinbelow) which contains an etched surface 12 which contains the desired printing image (not shown). The outer portions 13 and 14 of the surface 12 are unetched and, as explained below, may be advantageously used to expedite registry of the rotogravure printing cylinders when they are being changed. The cylinder 11 is disposed between two end portions 15 and 16. Journal bearings 17 and 18 are provided at the end portions 15 and 16, respectively, to provide for support and driving force of the cylinder within a conventional rotogravure printing press (not shown).

Figure 2:
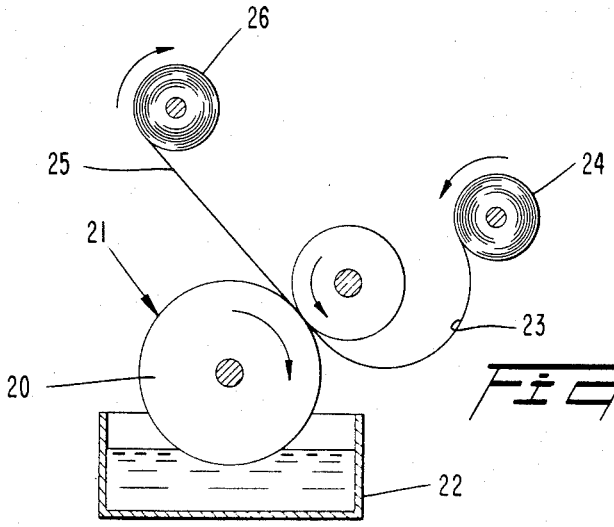
FIG. 2 is a representation of a rotogravure printing process.

While conventional rotogravure printing presses are well known, FIG. 2 shows a general representation of the principle involved. That is, the rotogravure printing cylinder 20 containing the etched printing image is partially immersed in a reservoir 22 of ink which is picked up by the etched areas (not shown). A doctor blade removes excess ink and returns same to the ink reservoir 22. A substrate 23 (paper, cloth or the like) is fed from a supply roll 24 between the rotogravure printing cylinder 20 and impression roller 24 which maintains a fixed pressure on the rotogravure cylinder to properly transfer the desired image. The printed substrate 25 is then wound on a take-up roll 26 or other passed to further handling in a conventional manner.

Figure 3:
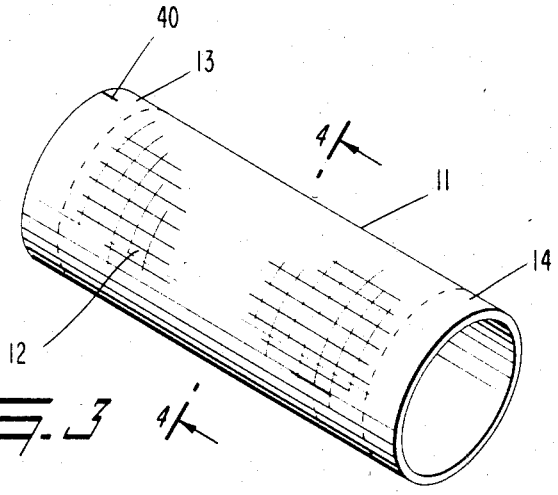
FIG. 3 is a perspective of a thin-walled metal coated, plastic cylinder.

The thin-walled, metal coated cylindrical sleeve 11 is shown generally in FIG. 3 and in an expanded partial cross-sectional view in FIG. 4.

The rotogravure printing cylinder of the present invention includes a number of layers applied in specific manner. First, a hollow cylinder of a phenolic resin or polyester containing fiber reinforcements 29 (e.g., glass fiber) which are added for reinforcement and dimensional stability is molded on a mandrel to provide the thin walled plastic cylinder 30 having a specific, close tolerance internal diameter and a particular thickness which generally will be in the range of about $\frac{1}{8}$ of an inch, although the latter can be adjusted for different mandrel sizes to a thickness of from about 1/16 to $\frac{1}{4}$ inch).

The fiber filled plastic core is then treated to texture or distort the surface to produce a "cavernous" surface (indicated generally as 31 in FIG. 4) for a better interlocking of a zinc layer which is thereafter applied. While this can be done by various means, it is preferred that it be done mechanically by sand blasting the plastic surface.

A thin, e.g., 10–40, generally about 15 to 25, mils thickness (one mil being one-thousandth of an inch) zinc coating 32 is applied to the textured plastic core 30 by conventional flame spray metallizing wire gun at about 300° F. to provide a zinc coat which is mechanically interlocked with the fiber reinforced plastic core by filling in the textured surface previously produced. While the temperature of the flame spray at the gun is about 300° F., the temperature of the deposited zinc particles is believed to be significantly less and particularly to be below the stability temperature limit of the fiber filled plastic base (that is, below about 220° to 240° F.).

Thereafter, a first copper layer 33 is also sprayed by plasma spray onto the zinc surface 32 to produce a copper layer of approximately 10–40, generally from about 15 to 25, mils thickness. It has been found that the copper particles applied by the plasma spray penetrate the zinc surface providing not only a mechanically interlocking but also some alloying in a diffusion zone 34 adjacent the interface between the copper layer 33 and the zinc layer 32. It is believed that the adherence between the two layers is more dependent on the interlocking (and therefore the velocity of the particle) than on any metallurgical alloying. The application of this particular layer by plasma spraying is also advantageous since copper layers are often formed by electrocoating which can cause surface contamination or a particular copper crystalline lattice formation which weakens the surface or causes spots. In the normal coating of copper onto a steel based rotogravure cylinder, the attraction between the copper and steel layers is based on the copper crystal structure. Here, because of the particular nature of application and the particular materials used, there is no dependence on a particular crystal lattice structure.

The application of the flame sprayed copper layer 33 onto the zinc coated, fiber-filled plastic core produces a basic gravure core which may be useful in some instances after etching or engraving. However, for rotogravure purposes, a further layer 35 of electrolytic copper in the range of 4 to 10, preferably 5 to 6, mils is then electrolytically deposited in a conventional fashion onto this basic gravure core. The hardness of the electrolytic copper can be substantially higher, (in the range Vickers hardness of 105 up to 200) than that of the flame sprayed copper (Vickers hardness of 105). The prior application of the sprayed zinc and copper layers 32 and 33 facilitates the electroplating application of copper layer 35 since they are present in an amount sufficient to effectively convert the sleeve into a conductive body (as opposed to a non-conductive plastic body).

This coated core is then polished and engraved in the same manner as a normal rotogravure cylinder. Any engraving process can be used. For example, the roll can be engraved by mechanical engraving, mechanical-electrical engraving or photo-engraving. This engraved sleeve can be used in publication printing but generally not in other areas, (for example packaging, tag and label, wall cover, floor covering). For the latter uses, a hard surface coating 36 of chromium or tungsten carbide of about 2 to 8 mils thickness can thereafter be applied. Advantageously, the tungsten carbide is applied by the process of plasma flame spray as shown in my U.S. Pat. No. 4,262,034. The chromium, if used, is normally put on by electroplating.

As shown in FIGS. 1 and 3, the sleeve 11 can be formed so that the etching or engraving leaves an unetched or unengraved portion 13 and 14 at each end of the sleeve 11. In this manner, the printing image will be always placed in the same relative lateral position in the printing press. In this manner, it is relatively easy to change sleeves and/or cylinders and still maintain the proper lateral alignment of the engraved printing image.

Also shown on the sleeve 11 is a register mark 40. A similar register mark 41 appears on the end portion 15 so that the sleeve can also be readily aligned up when replacing sleeves on the supporting structure. As will be apparent to those skilled in the art, this also makes the alignment of the rotogravure printing cylinder in the printing press considerably easier and faster than that obtainable when changing an entire conventional printed roll and thus offers significant advantages both in cost and time savings to the ultimate user. Instead of register marks 40 and 41, a small tab 77 (See FIG. 6) can be formed on the end portion 15 with a corresponding groove 78 in the cylinder to facilitate alignment.

The sleeve 11 as previously described can be used in any printing operation in which it may be supportably aligned in a printing press and used for printing. One such embodiment of a suitable mechanism to support and hold the sleeve in place and form the cylinder 10 is shown in FIG. 5. As shown therein, there is provided a rod generally indicated as 50 having a first (or register) end 15 with journal bearing 17 adapted to be placed into a printing press. The end portion 15 contains the register mark 41 which corresponds to the register mark 40 on the sleeve 11 (not shown). The rod has a first tapered portion 51, an intermediate flat portion 52 and a second tapered portion 53 also tapered in the same direction as tapered portion 51. Beyond the tapered portion 53, the rod has a flat threaded portion 54 and ends in the journal bearing 18.

Also shown in FIG. 5 is a sleeve portion generally indicated as 60. This sleeve portion 60 is adapted to receive the cylinder 11 (shown in dotted lines) such that the cylinder 11 abuts the flange of end portion 15. The outer diameter of the sleeve 60 is slightly less in the unassembled position (assembly described below) than the inner diameter of the metal coated plastic cylinder 11 and of end portion 16.

The sleeve portion 60 has an internal taper portion 61, an intermediate flat portion 62 and a second taper portion 63 which correspond to the first taper 51, intermediate flat portion 52 and second taper portion 53 of the rod portion 50. The outer portion of the sleeve 60 is formed into segmented fingers 64 and are joined by a split ring 65 to the rotable end portion 16 which is internally threaded to correspond to the threaded shank 54 of the rod portion 50.

In assembly, a sleeve 11 such as shown in FIG. 3 is placed about the sleeve portion 60. The sleeve 11 and sleeve portion 60 are the same length. The sleeve 11-sleeve portion 60 assembly is then placed over the rod portion 50 and tightened by screwing the threaded shank 54 into the hole threaded 66. The interaction of the two tapered portion 51 and 53 on the rod with the tapered portions 61 and 63 on the inside of the tube cause a slight expansion of the segmented fingers 64, into tight contact with and along essentially all of the inside diameter of the sleeve 11 thus firmly locking the sleeve in place and forming the rotogravure cylinder 10.

Other means of supporting the cylindrical sleeve 11 or removing the assembly from the machine will be apparent to those skilled in the art.

In a particular embodiment of the present invention, assembly 10 is designed to be placed within a printing machine with one end (that is, the end having end portion 16) being releasable to permit contraction of the segmented fingers 64 and removal of sleeve 11 without removing the journals and supporting structure from the machine. In this manner, the cylinder 11 with its printing image may be quickly and easily removed from a printing press and a new cylindrical sleeve (with the same or new printing image) quickly and easily assembled thereon.

Figure 6:
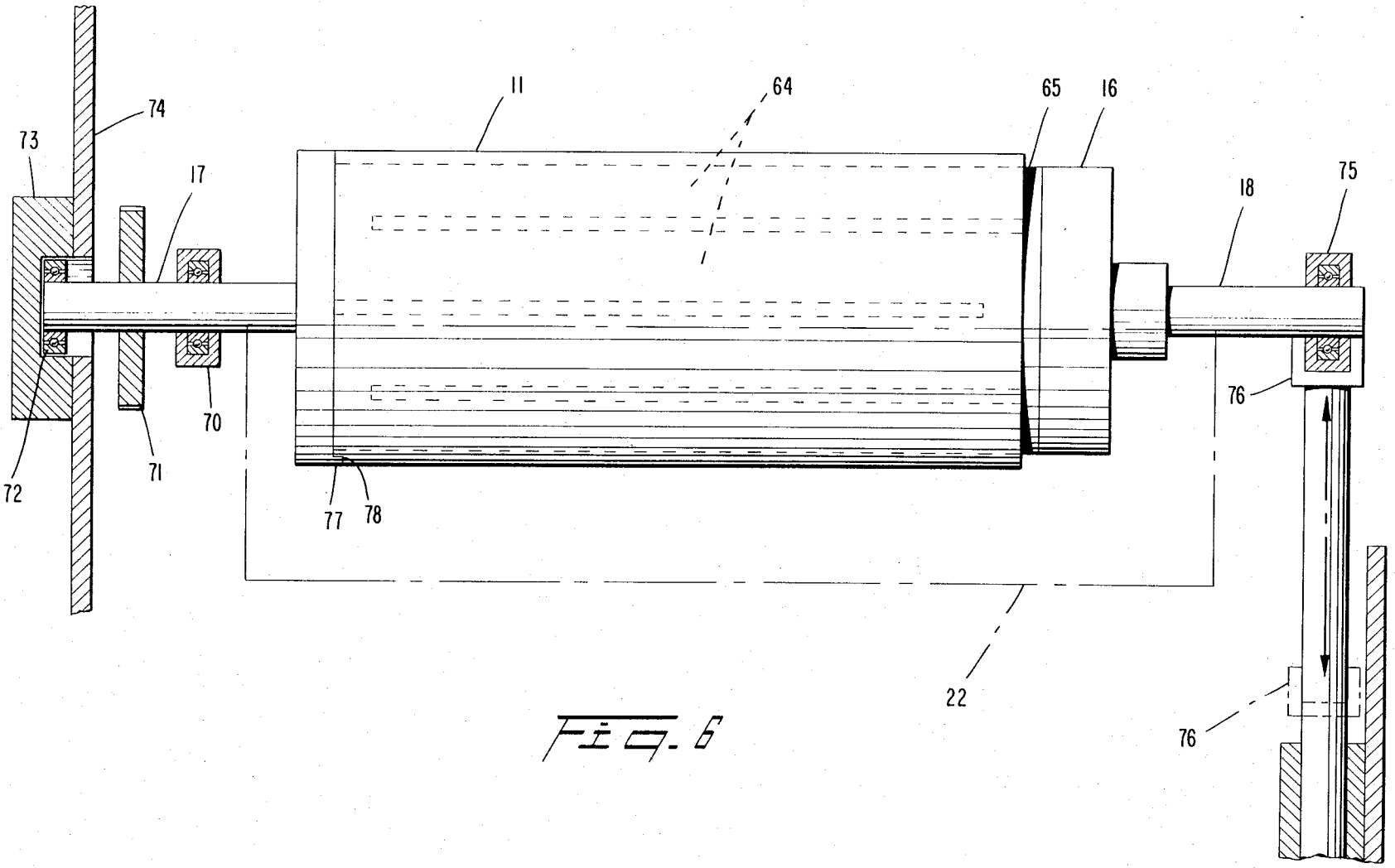
FIG. 6 is a partial cross-sectional view of a portion of a rotogravure printing press useful in the present invention.

As shown in FIG. 6, this may be accomplished by supporting journal 17 through press bearing 70 (housing therefor not shown but fixed in place) and cylinder drive gear 71 in a cantilever support bearing 72 which is disposed in a support housing 73 attached to the press side frame 74. When in operation, the cantilever support bearing 72 does not contact the support housing 73.

The cylinder 10 (the parts of which shown being identified by the same numerals as in the other Figures) is supported at the other journal end 18 by a bearing 75 which is fitted onto journal 18 and remains in place thereon. Bearing 75 is supported by retractable bearing housing 76 which is pneumatically or hydraulically operable (not shown) to a running (or normal operating) position shown in solid lines and a retractable position shown in dotted lines. Bearing 75 has an outer diameter less than the inner diameter of sleeve 11 and the press side frame 79 in this instance is of a height to expose at least the diameter of the cylinder 10.

In operation, when the sleeve is desired to be removed, the retractable journal bearing support 75 is retracted to the dotted line position, the assembly is released by unscrewing rotatable end portion 16 to release the expanded finger segments 64 thus releasing the cylinder sleeve 11 which can then be removed from the sleeve portion 60 over the end portion 16 and bearing 74. A new cylinder sleeve can be placed on the sleeve in the same fashion and the assembly then tightened by rotating end portion 16. Prior to tightening, the register marks 41 on the end portion and 40 on the cylinder can be aligned (or the tab 77 inserted into groove 78) and the printing distances 13 and 14 will be automatically aligned because the cylinder is always etched or engraved at that distance and each cylinder is always placed in the same position (that is, abutting the end portion 15).

It will thus be seen that the rotogravure cylinder of the present invention offers a substantial opportunity for rapid change of rotogravure printing images.

The particular mode of construction of the present invention is very advantageous in that the initial layer of zinc (which is applied quickly and at a relatively low temperature to avoid degradation of the plastic core) prevents the copper, which is applied at a much higher temperature, from degrading the plastic surface. It has been found that the copper cannot be applied directly onto the plastic without causing potential separation problems. In addition, the sprayed copper layer has a density which helps to obtain the proper quality of the electroplated copper layer which needs to be of high quality since it is the layer which is photoengraved. In reuse of the cylinders, only the electrolytic copper layer or a portion thereof is generally removed because the engraved image layer is generally only about 3 mils thick and a new electrolytic copper layer may be applied, if necessary.

The lightweight nature of the rotographic cylinder of the present invention eliminates mechanic time and damage which can often be done during a cylinder change and simplifies storage problems for rotogravure printers who may have as many as 2,000 or more rolls in storage. Since the rolls generally used today are copper coated steel cylinders, it will be apparent that the use of a thin walled, metal coated plastic cylinder of the present invention offers significantly improved advantages.

It will also be apparent that the sleeve of the present invention is in and of itself incapable of use in a rotogravure printing machine without an internal support structure because of the possibility of flexing under the pressures used. Thus, a suitable supporting structure must be provided. At the same time, the sleeves themselves offer significant advantages and may be used with any such suitable support.

In addition, more than one sleeve 11 can be used in any given assembly. That is, two or more can be applied across the length of the rod portion and any one of which may be changed at any given time in accordance with the above procedures.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A rotorgravure printing cylinder combination comprising at least one etchable thin walled, plural metal coated hollow plastic cylinder sleeve comprising a thin walled hollow plastic cylinder having a pretreated textured or distorted surface, said plastic cylinder having a flame-sprayed zinc layer interlocked thereon by engagement of the flame-sprayed zinc layer with the textured or distorted surface of the plastic cylinder, a first copper layer applied on said zinc layer and a second copper layer of the same or greater hardness than the said first layer applied on said first copper layer, said second copper layer being capable of being etched; means within said hollow plastic cylinder sleeve sufficient to provide support for said cylinder during printing; and journal means disposed at the ends of the cylinder sleeve to provide support for said cylinder in a rotogravure printing machine.

2. The rotogravure printing cylinder combination of claim 1 wherein the cylinder support means comprises an expandable mandrel which allows the cylinder sleeve to be slid thereon in the unexpanded state and which is expandable to provide support on the inner diameter of the hollow plastic sleeve along a substantial length of the sleeve.

3. The rotogravure printing cylinder combination of claim 1 wherein cylinder support means includes means for determining the length of the sleeve and register means.

4. The rotogravure printing cylinder combination of claim 3 wherein the outer surface of the sleeve also contains register means whereby the sleeve may be quickly brought into approximate registration by juxtaposition of the sleeve register mark with the register means on the cylinder support means.

5. The rotogravure printing cylinder of claim 1 wherein two etchable metal coated hollow plastic cylinder sleeves are disposed on said support means.

6. In a rotogravure printing press including at least one rotogravure roll or cylinder and at least one impression roll, the improvement which comprises using the rotogravure printing cylinder of claim 1 as the rotogravure cylinder.

7. In the rotogravure printing press of claim 6, the further improvement wherein at least one of the journal means is maintained fixed in the said printing press.

8. In the rotogravure printing press of claim 7, the further improvement wherein means are provided to selectively release the journal means at the other end of the cylinder sleeve whereby the cylinder sleeve may be removed without removing the journal means and the support means from the said printing press.

9. In the rotogravure printing press of claim 8, the further improvement wherein the said other journal means includes a bearing fixed thereon, said bearing having an outer diameter less than the inner diameter of the cylinder sleeve and wherein the said means to selectively release the journal means is a slideable bearing support.

10. The rotogravure printing cylinder of claim 1 wherein the first copper layer is flame-sprayed onto the first zinc layer to form a mechanical and metallurgical bond therebetween.

11. A rotogravure printing cylinder comprising at least one etchable thin walled, plural metal coated hollow plastic cylinder sleeve comprising a thin walled hollow plastic cylinder having a pretreated textured or distorted surface, said plastic cylinder having a flame-sprayed zinc layer interlocked thereon by engagement of the flame-sprayed zinc layer with the textured or distorted surface of the plastic cylinder, a first copper layer applied on said zinc layer and a second copper layer of the same or greater hardness than the said first layer applied on said first copper layer, said second copper layer being capable of being etched.

12. The rotogravure printing cylinder sleeve of claim 11 wherein the first copper layer is applied by spraying.

13. The rotogravure printing cylinder sleeve of claim 12 wherein the second copper layer is applied electrolytically.

14. The rotogravure printing cylinder sleeve of claim 11 wherein the sleeve is etched and a hard surface coating is applied onto the etched surface.

15. The rotogravure printing cylinder sleeve of claim 14 wherein the hard surface coating is tungsten carbide.

16. The rotogravure printing cylinder sleeve of claim 11 wherein the plastic cylinder comprises a phenolic resin or polyethylene containing a fiber filling.

17. A process for forming a sleeve adapted for use in rotogravure printing which comprises providing a thin wall plastic cylinder, distorting the surface thereof to provide means to interlock a subsequent zinc coating onto the plastic, applying a zinc coating by flame spraying to mechanically interlock with the plastic substrate, plasma spraying a thin layer of copper onto the zinc layer and electroplating a further layer of copper onto the sprayed copper layer.

* * * * *